US005081940A

United States Patent [19]

Motomura et al.

[11] Patent Number: 5,081,940

[45] Date of Patent: Jan. 21, 1992

[54] WASTE DISPOSAL METHOD AND APPARATUS

[75] Inventors: Takehiko Motomura, Funabashi; Hitoshi Hagihara, Tokyo; Satoshi Inoue, Asaka, all of Japan

[73] Assignee: Ishikawajima-Harima Heavy Industries Co., Ltd., Tokyo, Japan

[21] Appl. No.: 610,212

[22] Filed: Nov. 7, 1990

[30] Foreign Application Priority Data

Nov. 10, 1989 [JP] Japan ..... 1-293351

[51] Int. Cl.[5] ..... F23G 5/00

[52] U.S. Cl. ..... 110/346; 110/165 R; 110/185; 110/190; 110/246; 110/255; 110/259

[58] Field of Search ..... 110/259, 255, 165 R, 110/185, 190, 346, 246

[56] References Cited

U.S. PATENT DOCUMENTS 4,201,141 5/1980 Teodorescu et al. ..... 110/259
4,840,130 6/1989 Quiel ..... 110/165 R

FOREIGN PATENT DOCUMENTS 0165818 12/1981 Japan ..... 110/259
0168719 7/1986 Japan ..... 110/259
0123913 5/1988 Japan ..... 110/259

*Primary Examiner*—Edward G. Favors
*Attorney, Agent, or Firm*—Harness, Dickey & Pierce

[57] ABSTRACT

Waste is combusted by an incinerator and becomes an ash. The ash is transferred to a melting furnace to be melt therein. The ash contains unburned carbon and the melting at the melting furnace is influenced by an amount of the unburned carbon. The amount of unburned carbon largely depends on a gas temperature at an waste inlet of the incinerator and an waste burn-out point in the incinerator. The waste disposal method, using the incinerator and the melting furnace, comprises the steps of detecting the gas temperature at the waste inlet of the incinerator, detecting the burn-out point of waste combustion in the incinerator, controlling a waste transfer speed in the incinerator and controlling a flow rate of air fed into the incinerator such that the detected temperature and burn-out point remain within repsective predetermined ranges, which in turn brings the amount of the unburned carbon remaining in the ash to a desired value, whereby the melting at the melting furnace is controlled to a desired melting.

23 Claims, 5 Drawing Sheets

WASTE DISPOSAL METHOD AND APPARATUS

BACKGROUND OF THE INVENTION

1. Technical Field

The present invention relates to a method and an apparatus for incinerating refuses and melting ash produced upon an incineration of the refuses.

2. Background Art

Today, various methods of melting refuses at high temperture and solidifying incineration ashes (incineration residue) are known in the art. Such methods have been developed for a reduction of weight and volume of an incineration reside and for a recycling of the refuses.

For an apparatus to carry out such a method, there are, for example, an electric melting furnace as shown in FIG. 5 of the accompanying drawings and a film melting furnace as shown in FIG. 6.

Referring first to FIG. 5, the electric melting furnace 1 is designed to have an incineration ash A fed from a supply port 2 formed at the top of the furnace 1 and melt the ash A with the arc heat produced by electrodes 3 installed in the furnace 1. The ash A is melt to a melt B, which is generally called "molten bath", and the melt B is discharged from an exhaust port 4 formed in a lateral wall of the furnace 1 and then solidified.

Referring to FIG. 6, the film melting furnace 11 is designed to have an inlet 12 through which the incineration ash A is dumped into of the furnace 11, and the ash A is melt to the melt B from the surface 14 of the ash A by flames from the oil burner 13. The melt B is discharged from an outlet 15 formed at the bottom of the furnace 11.

However, the above-mentioned conventional method and apparatus have a disadvangate that a large amount of fuel or electric power is required to melt the ash, thereby raising an operation cost.

The applicant of the present invention proposed a waste disposal method, which is disclosed in Japanese Patent Application No. 62-232646, for example, to eliminate the above-mentioned disadvantage. FIG. 7 shows a schematic view of an apparatus to carry out the improved method. The refuses S are incinerated in a rotary stoker 31 such that the incineration residue (ash) A contains a certain amount of carbon (unburned carbon). The ash A is transferred to the ash melting furnace 33 via an after-burning stoker 32. Combustion air is supplied into the furnace 33 to melt the ash A with the unburned carbon remaining in the ash A.

However, the apparatus of FIG. 7 cannot perform a stable incineration since the amount of unburned carbon contained in the ash A is an important factor for the incinerator but is not controlled, i.e., the method of controlling the unburned carbon is not disclosed in the above-mentioned Japanese Patent Application.

SUMMARY OF THE INVENTION

An object of the present invention is to provide a method and an apparatus which makes it possible to control an amount of unburned carbon contained in the incineration ash.

In order to accomplish the above object, experiments were conducted and it was found that the melting at the melting furnace is influenced by an amount of the unburned carbon remaining in the ash and that a certain relation exists between a burn-out point (indicated by "M" in FIG. 7) in the stoker type incinerator and the amount of the unburned carbon contained in the incineration ash. The inventors also found that the amount of unburned carbon may be affected by a temperature of gas at a refuse inlet of the incinerator.

The present invention provides a method of incinerating refuses, using a main incinerator combusting the refuses and a melting furnace melting ashes produced upon an incineration at the main incinerator, comprising the steps of detecting a temperature of gas at an refuse inlet of the main incinerator, detecting a burn-out point of the refuse in the main incinerator, adjusting a refuse transfer speed through the main incinerator and an amount of air to be supplied into the main incinerator such that a detected temperature and a detected burn-out point respectively fall in predetermined ranges.

The method may further include the step of detecting oxygen content of an exhaust gas generated upon the incineration of the refuses in the main incinerator and the detected oxygen content may be taken in account in adjusting the refuse transfer speed through the main incinerator and the amount of air to be fed into the main incinerator. If the main incinerator possesses a pushing device transferring the refuses through the main incinerator, a time interval of the pushing by the pushing device may be also adjusted. An incineration transfer speed from the main incinerator to the melting furnace may also be a factor to be adjusted.

The refuse transfer speed, the amount of air fed into the main incinerator and other factors may be adjusted in a manner such that the unburned carbon content becomes 6% or more.

According to one experiment, in a case where the total length of the main incinerator is 8.4 m in the refuse transfer direction, satisfactory results came out when the burn-out point was adjusted in a range between 0.5 m and 3.0 m from the downstream end of the main incinerator.

According to another experiment, in a case where the total length of the main incinerator is 8.4 m in the refuse transfer direction, satisfactory results came out when the burn-out point was adjusted in a range less than 3.0 m from the downstream end of the main incinerator.

The present invention also provides an apparatus for carrying out the above-mentioned method. The apparatus comprises a temperature sensor for detecting a gas temperature at the refuse inlet of the main incinerator, a detection camera for detecting the refuse-burn-out point in the main combustion incinerator, a rotary drive unit for rotating the main incinerator to transfer the refuses in the main combustion furnace at a specified rate, an air supply means for feeding air into the main incinerator, a damper or regulator means for controlling a flow rate of the air to be fed into the main incinerator, and a controller for controlling the rotary drive unit and the regulator means to bring the detected gas temperature and the detected refuse-burn-out point to be within respective predetermined ranges.

It is preferable for the apparatus to be provided with an $O_2$ sensor for detecting an oxygen concentration of gases discharged from the main incinerator since the oxygen concentration could be an important factor.

The apparatus may have a refuse feeding pusher for transferring the refuses through the main incinerator. Also, the apparatus may include a wind box or a header which divides the combustion air supplied from air supply sources to a plurality of air streams fed into corresponding sections of the main incinerator. In addition, an after-buring stoker may be installed between the main combustion furnace and the melting furnace.

The present invention has following outstanding advantages:

Since the gas temperature at the refuse inlet of the main incinerator and the refuse burn-out point in the main incinerator are detected and the transfer speed and the combustion air fed into the main incinerator are controlled in a manner such that these detection values remain within the predetermined ranges, the incineration ashes which contain a proper volume of unburnt carbon are constantly fed to the ash melting furnace, thereby achieving a stable continuous melting.

DESCRIPTION OF THE PREFERRED EMBODIMENTS

A preferred embodiment of the present invention will be described in detail hereinafter with reference to the drawings.

Figure 1:
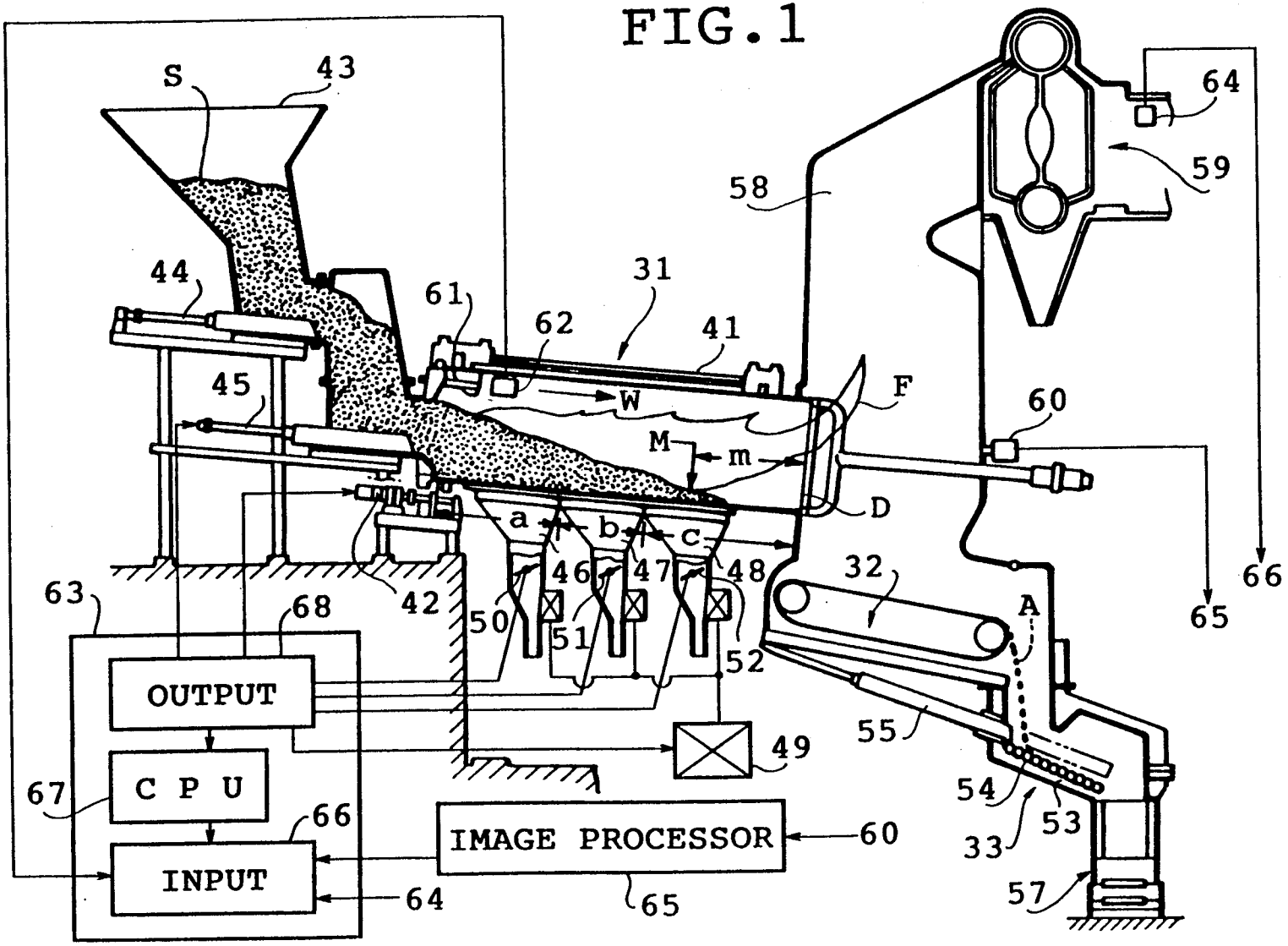
FIG. 1 shows a schematic construction of one embodiment of a waste disposal arrangement according to the present invention.

Referring to FIG. 1, a waste diposal arrangement includes a rotary stoker type incinerator 31 which serves as a main combustion furnace, an after-burning stoker 32 and an ash melting furnace 33. The main incinerator 31, the after-buring stoker 32 and the melting furnace 33 are conntected in series in this order, and refuses S are treated through these three elements.

A main body 41 of the incinerator 31 is cylindrical in shape. The main body 41 is rotated about its longitudinal axis by a drive mechanism 42 provided beneath one end of the main body 41. The longutidinal axis of the main body 41 or the incinerator 31 is inclined downward in the direction W the refuses S are carried. A hopper 43 is connected with an inlet of the main body 41 of the incinerator 31 to introduce the refuses S into the incinerator 41. The refuses S fed through the hopper 43 are pushed into the rotating incinerator main body 41 by pushing devices 44 and 45. The refuses S (and/or the ash A) is moved in the downstream direction (right in FIG. 1) at a substantially constant speed upon rotation of the main body 41 by the drive mechanism 42. The pushing devices determines a thickness or a height of the refuses S in the main incinerator 31 and the height of the refuses S may affect the refuse transfer speed through the main incinerator 31.

At the bottom of the main body 41 of the main incinerator 31, there are provided three wind boxes 46, 47 and 48 such that three streams of combustion air are respectively introduced into three sections a, b and c of the main body 41 from a single air supply source 49. These wind boxes 46, 47 and 48 are separately controlled by respective dampers 50, 51 and 52, i.e., the flow rate of air supplied into the main body 41 is adjusted by the dampers.

The after-burning stoker 32 is connected to the downstream end of the main incinerator 31 and transfers an incineration ash A discharged from the downstream end D of the main incinerator 31 to the ash melting furnace 33. The after-burning stoker 32 is originally designed to combust unburned substances contained in the incineration ash A so as to discharge the "cleaner" ash. However, in this particular embodiment, the after-burning stoker 32 mainly serves as a feeder to prevent an overcombustion of unburned carbon remaining in the incineration ash A.

The ash melting furnace 33 includes a hearth 53, in which a plurality of nozzles (not illustrated) to inject the combustion air are provided, a high-temperature heating body 54 embedded in the hearth 53 and a pusher 55 to push the incineration ash A carried on the hearth 53. The ash melting furnace 33 melts the transferred incineration ash A at a high temperature and moves the melt onto a water-sealed carrying conveyor 57. The melt is then cooled and solidified.

Another furnace 58 is provided over the downstream end D of the main furnace 31 and the after-burning stoker 32 and a boiler 59 is mounted on the top of the furnace 58 to recover the heat energy of an exhaust gas coming from the incinerator 31 and the stoker 32.

A camera 60 for detecting a burn-out point M in the main body 41 of the main incinerator 31 is provided outside the main incinerator 31. A temperature sensor (thermocouple) 62 for incinerator 31. Also a controller 63 is provided to control the operating conditions of the incinerator 31 in accordance with information from the camera 60 and the temperature sensor 62. In this embodiment, an $O_2$ sensor 64 for detecting the oxygen content h of the exhaust gas from the main incinerator and the after-burning stoker 32 is provided near the downsteam end of the furnace 58 and the detected oxygen concentration is sent to the controller 63.

The refuse burn-out point detection camera 60 is mounted on the wall of the furnace 58 to face the downstream end D of the main body 41 of the main incinerator 31 so that the camera 60 catches the refuse S and flame F in the incinerator 31 as images. These images are fed to an image processor 65 to obtain a distance m between the downstream end D of the incinerator body 41 and the end M of combustion in the incinerator 31. The obtained distance is input to the controller 63.

The temperature sensor 62 is located above the most upstream wind box 46 among the three. The sensor 62 detects the temperature t of the gas near the refuse inlet of the main incinerator 31.

The controller 63 includes an input 66, a processing unit (CPU) 67 and an output 68. The input 66 is connected to various detection devices (the refuse burn-out point detection camera 60, the temperature sensor 62 and the $O_2$ sensor 64). The CPU 67 makes a judgement in accordance with the input information. The output 68 transmits signals to drive sections information. The output 68 transmits signals to drive sections of the incinerator 31 in accordance with the judgment made by the processing unit 67. The output section 68 is connected to the rotary drive unit 42, the dampers 50–52, the air supply source 49 and the refuse feeding pusher 45 and outputs the operating signals to them.

In the processing unit 67, preset reference values are stored in a memory thereof. The unit 67 compares the input detection values with the reference values, and when there is any difference between them, it calculates a proper transfer speed of the refuses S or the ash A, a flow rate of the combustion air to be fed into the main incinerator 31, a dividing ratio of air into the sections a, b and c, and a pushing interval of the pusher 55 to make the difference substantially zero.

Figure 2:
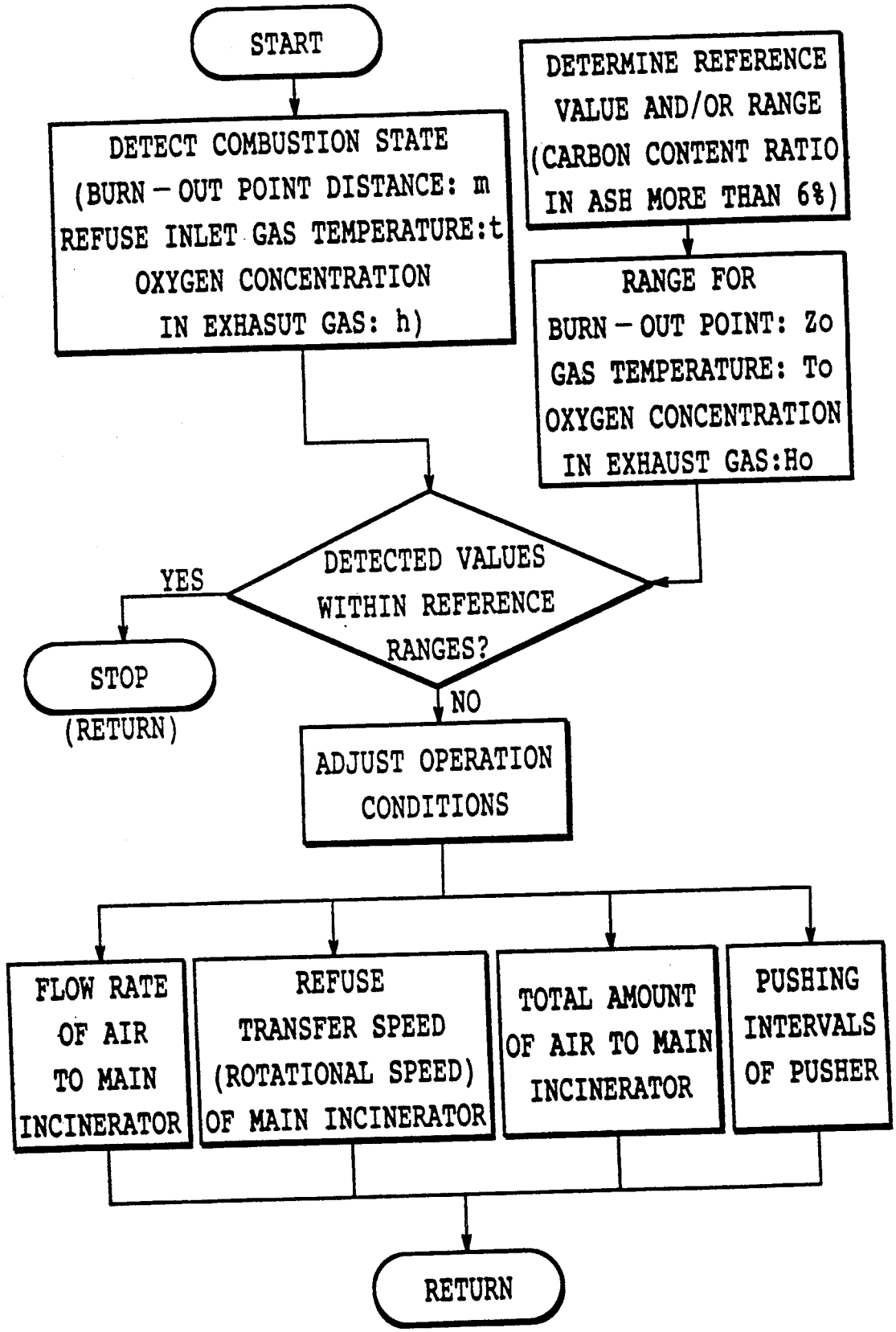
FIG. 2 is a flow chart showing the operation of the apparauts of FIG. 1.

Next, the refuse incineration process of this embodiment will be described with FIGS. 2, 3 and 4.

Prior to the incineration of the refuses S, various reference values or ranges which will compared with the detection values are given to the controller 63.

Figure 3:
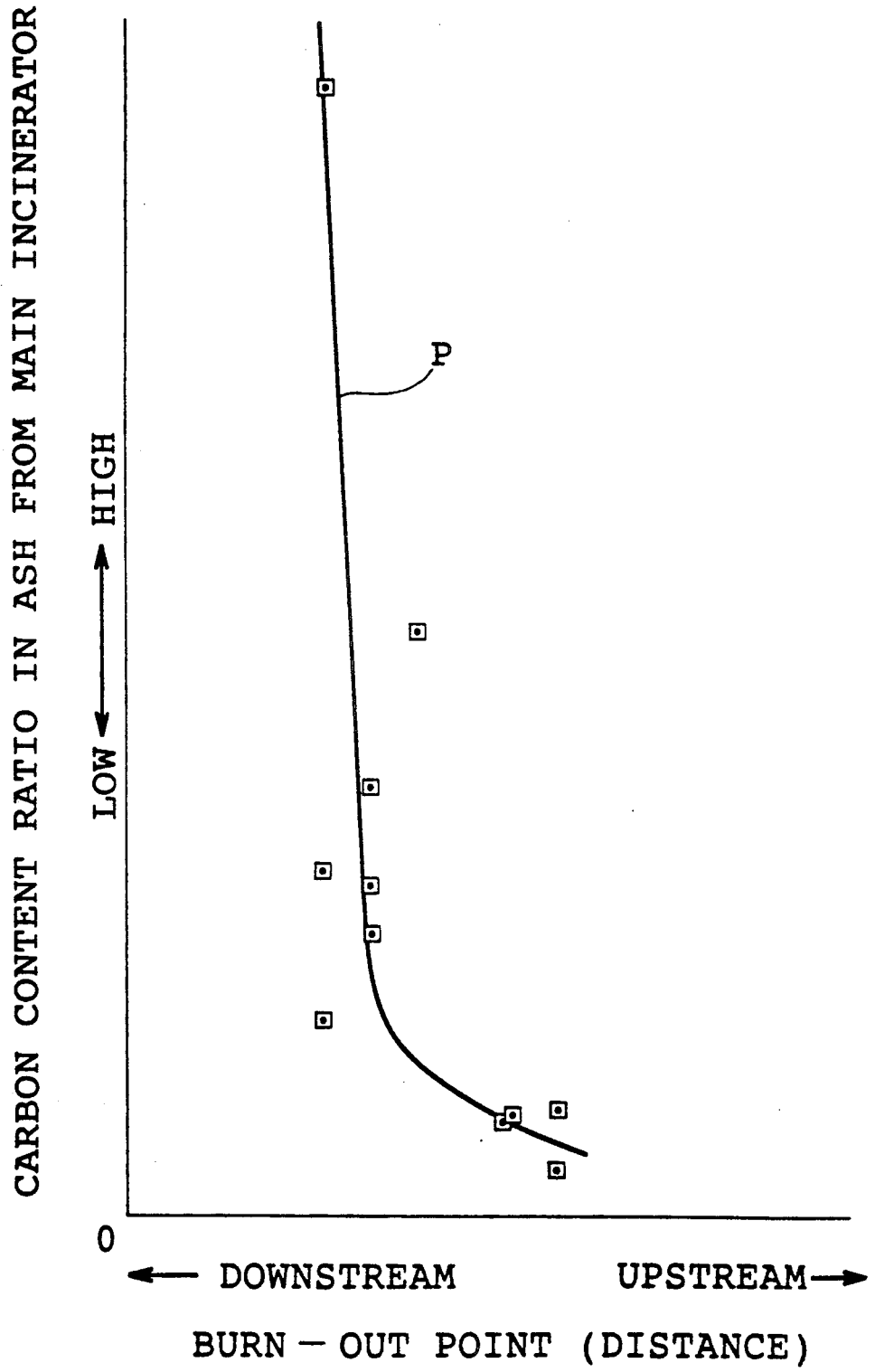
FIG. 3 is a diagram showing the relationship between a refuse burn-out point and a remaining carbon content.

As mentioned before, the inventors of the present application found that there is a certain relation between the distance m or the burn-out point M and the volume (or ratio) of the remaining unburned carbon and the relationship obtained by experiments by the inventors is shown in FIG. 3. In this embodiment, a prefarable range Zo of the distance m is determined based on the approximate correlation courve P in length of 8.4 m being employed, the prefarable range Zo becomes between 0.5 m and 3.0 m or less than 3.0 m.

Figure 4:
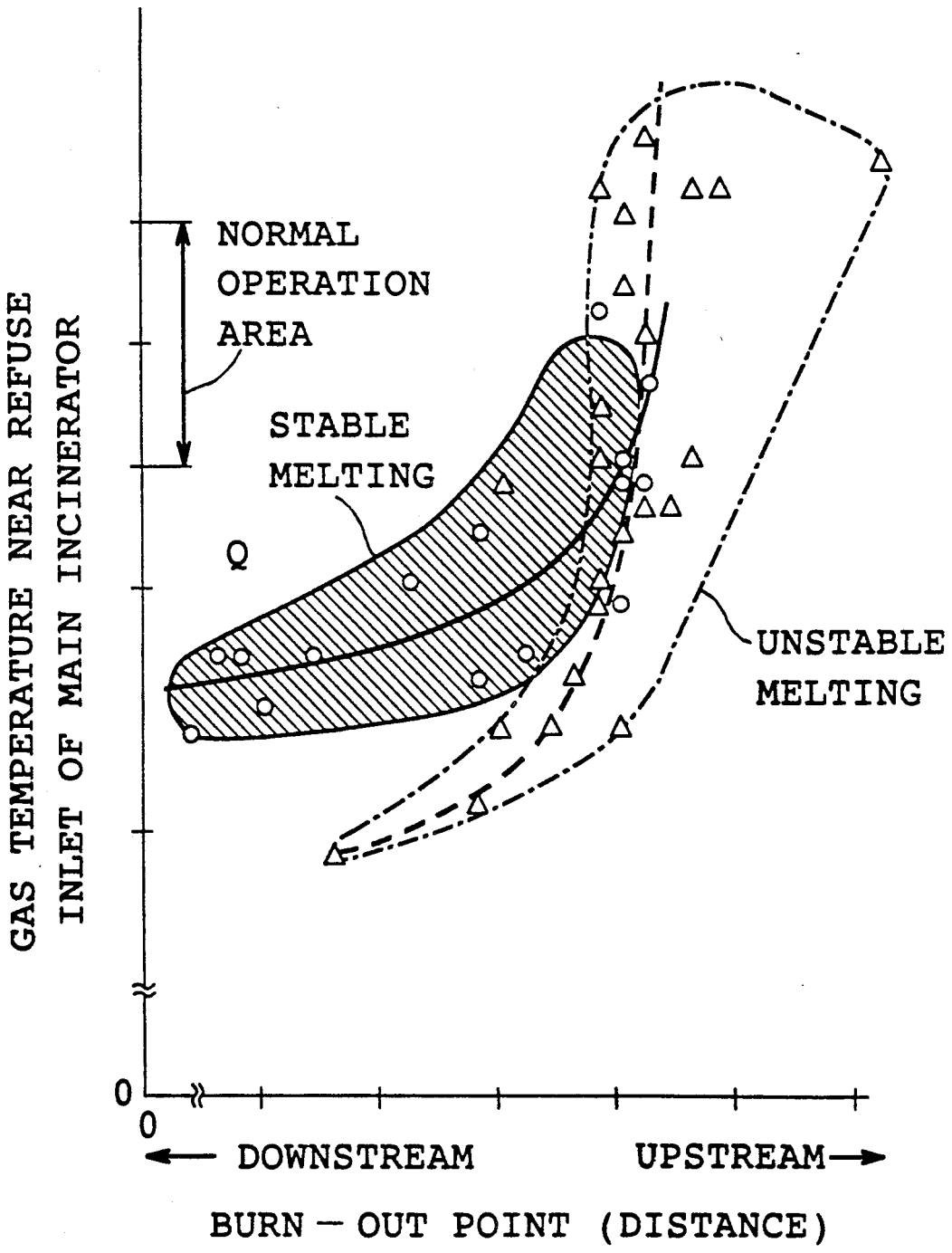
FIG. 4 is a diagram showing a relationship between the refuse combustion end point and the gas temperature at a refuse inlet of a main incinerator.
Figure 5:
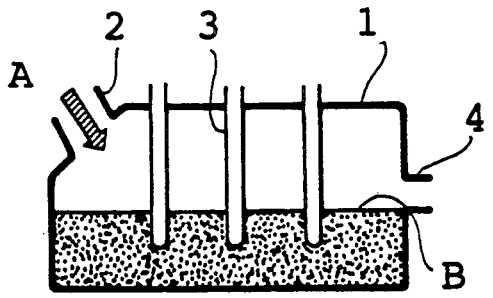
FIG. 5 is a sectional view of a conventional melting furnace.
Figure 6:
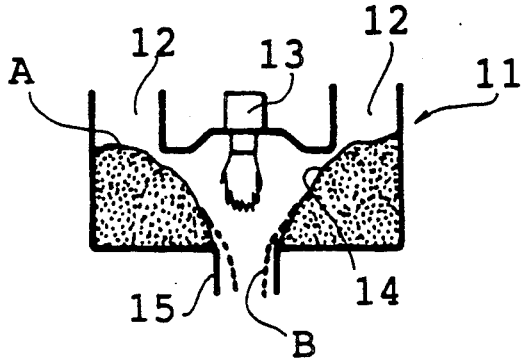
FIG. 6 is a sectional view of another conventional melting furnace.
Figure 7:
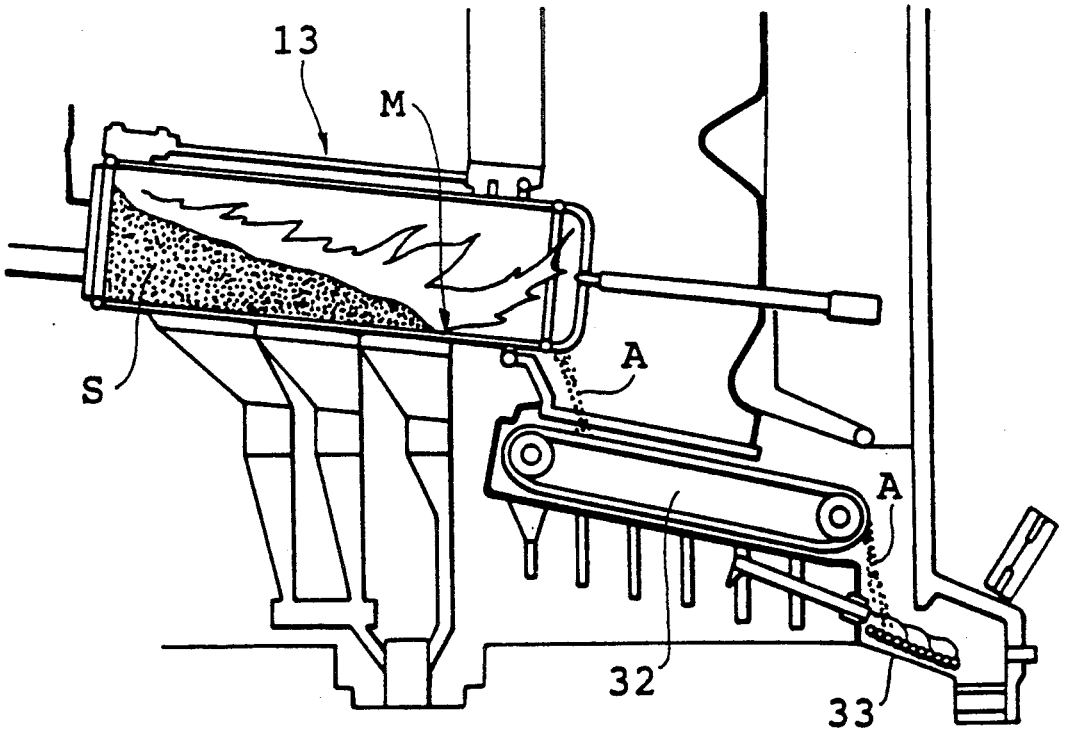
FIG. 7 is a sectional view of a waste disposal apparatus, which is a relevant art of the present invention.

Referring then to FIG. 4, there is shown a relation between the burn-out point M and the temperature t of the gases near the inlet of the main incinerator 31. A shaded area indicates a case where the ash A is melted at a high temperature and becomes a smooth melt whereas a non-shaded area indicates a case where the ash A is melt at a relatively low temperature and has some viscosity. In either case, it is seen that the gas temperature t is an important factor to predict the carbon content of the exhaust gas. This embodiment deals with the case of shaded area and a proper temperature range To is determined in accordance with the approximate correlation curve Q of the shaded area. The proper temperature range To is set to be lower than the temperature range for a normal operation shown in FIG. 4.

Also in FIG. 4, the exhaust gas is discriminated into that with low oxygen content (indicated by ○, enclosed by the solid line) and that with high oxygen content (indicated by Δ, enclosed by the single-dot line). With this discrimination, it is seen that the ash containing relatively high concentration oxygen cannot be melt in a stable state in the melting furnace whereas the ash containing relatively low concentration oxygen is melt stably. Therefore, the proper oxygen concentration for the stable melting at the melting furnace is a relatively low value.

These reference values (range) Zo, To and Ho set in the above-mentioned manner are input to the memory unit (not shown) of the controller 63 beforehand.

As the refuse S is fed into the incineration 31 and the incineration starts, all the detection devices start functioning. Specifically, the temperature sensor 62 detects the gas temperature t at the inlet of the incinerator 31 and inputs the information to the controller 63. The controller 63 judges whether the input temperature t is within the reference range To. If it is outside the range, the controller 63 adjusts the opening degree of the damper 50 of the most upstream wind box 46 to promote or restrict the combustion near the inlet of the incinerator 31.

The refuse burn-out point detecting camera 60 detects the distance m of the refuse burn-out point M and outputs a data of the distance m to the controller 63. The controller 63 transmits the operating signals to the rotary drive mechanism 42 to increase the rotational speed of the incinerator 31 thereby increasing the transfer speed of the refuse S through the incinerator 31 when the distance m is outside the proper range Zo, i.e., when the burn-out point M is a point more upstream or lefter than an upstream limit of the range Zo in FIG. 1, whereas it decreases the transfer speed of the incinerator 31 when the burn-out point M is a point downstream of a downstream limit of the range Zo. By controlling the pushing intervals of the refuse feeding pusher 45, the height (thickness) of refuse S in the incinerator 31 can be raised or lowered, i.e., it is also possible to change the refuse burn-out point position by the control of the pusher 45.

The $O_2$ sensor 64 detects the oxygen concentration h in the exhaust gas and transmits it to the controller 63, and when the oxygen concentration is higher than a predetermined value, the flow rate of the combustion air supplied into the incinerator 31 is decreased by controlling the air supply source 49 and the dampers 50, 51 and 52.

With these adjustments, the operation of the incinerator 31 is maintained in the proper operating range shown in FIG. 4. In other words, the incineration ash A contorolled to have a proper residual carbon content is transferred to the ash melting furnace 57 and a desired high-temperature stable melting is carried out in the melting furnace 57.

In this manner, the refuse burn-out point M or the distance m and the incinerator inlet gas temperature t are detected and the rotating speed of the incinerator 31 and the upstream-most combustion air flow rate are controlled to values in the respective proper reference ranges Zo and To. Therefore, grasping the initial combustion condition of the refuse S leads to the prompt operation adjustment. In other words, the proper control of the unburned carbon volume is realized and the incineration ash A with proper unburned carbon is fed to the ash melting furnace 33 without causing any delay in control.

In addition, since the oxygen concentration h in the exhaust gas is detected by the $O_2$ sensor 64 and the flow rates of the three air streams are adjusted to bring the detected oxygen content h fall in the predetermined range Ho, a more reliable and stable melting can be expected.

In the present enbodiment, although a rotary stoker type incinerator is employed as a main incinerator 31, another type of mechanical furnace, such as a caterpillar travelling type stoker, a step reverse sliding type stoker and a parallel-oscillation step type stoker may be employed. In addition, although the air to be fed into the main incinerator 31 is divided into the three streams in the illustrated embodiment, the air streams may be two, four or more, or the air may not be divided and only a single air stream is introduced to the incinerator 31.

We claim:

1. A method of incinerating refuses, using a main incinerator which combusts the refuses, the main incinerator having an inlet through which the refuses are fed into the main incinerator and an outlet through which the refuses are discharged from the main incinerator, comprising the steps of:

(A) transferring the refuses through the main incinerator;

(B) feeding air into the main incinerator to combust the refuses;

(C) melting ashes produced upon the combustion of the step (B) by use of unburned carbon contained in the ashes;

(D) detecting a temperature of gas at the refuse inlet of the main incinerator;

(E) detecting a point at which the combustion of the step (B) ends in the main incinerator (which point is called "burn-out point");

(F) determining a relation among an amount of the unburned carbon contained in the ash, the gas temperature at the refuse inlet and the burn-out point; and (G) adjusting a speed of the refuses transferred through the main incinerator of the step (A) and adjusting a flow rate of air of the step (B) in a manner such that the temperature detected at the step (D) and the point detected at the step (E) fall in respective predetermined ranges to control the amount of the unburned carbon to a desired value.

2. The method of claim 1, further including the step of (H) detecting oxygen concentration of exhaust gas generated upon the combustion at the step (B), and wherein in the step (G) the refuse transfer speed and the air flow rate are adjusted in a manner such that the oxygen concentration detected at the step (H) also remains in a predetermined range in addition to the gas temperature and the burn-out point.

3. The method of claim 1, further including the step of (G) pushing the refuses in the main incinerator at intervals, and wherein in the step (F) the pushing intervals of the step (G) is also adjusted in addition to the transfer speed of the refuses and the flow rate are.

4. The method of claim 2, further including the step of (G) pushing the refuses in the main incinerator at intervals, and wherein in the step (F) the pushing intervals of the step (G) is also adjusted in addition to the transfer speed of the refuses and the flow rate are.

5. The method of claim 3, further including the step of (I) dividing the air of the step (B) into a plurality of streams, and wherein in the step (G) the air division at the step (I) is also adjusted in addition to the refuse transfer speed, the flow rate are and the pushing intervals.

6. The method of claim 4, further including the step of (I) dividing the air of the step (B) into a plurality of streams, and wherein in the step (G) the air division at the step (I) is also adjusted in addition to the refuse transfer speed, the flow rate are and the pushing intervals.

7. The method of claim 1, wherein the step (G) is performed to adjust the concentration of the unburned carbon contained in the ash to be 6% or more.

8. The method of claim 6, wherein the step (G) is performed to adjust the concentration of the unburned carbon contained in the ash to be 6% or more.

9. The method of claim 4, wherein the predetermined range for the point is between 0.5 m and 3.0 m from the outlet of the main incinerator when the total length of the main incinerator is 8.4 m.

10. The method of claim 5, wherein the predetermined range for the point is between 0.5 m and 3.0 m from the outlet of the main incinerator when the total length of the main incinerator is 8.4 m.

11. The method of claim 8, wherein the predetermined range for the point is between 0.5 m and 3.0 m from the outlet of the main incinerator when the total length of the main incinerator is 8.4 m.

12. An apparatus for incinerating refuses, comprising:

a main incinerator for combusting the refuses in the main incinerator with air being supplied into the main incinerator, the main incinerator having a longitudinal axis, an inlet through which the refuses are fed into the main incinerator and an outlet through which the refuses are discharged from the main incinerator;

a melting furnace connected to the main incinertor for melting ashes produced upon combustion at the main incinerator with carbon remaining in the ashes;

a temperature sensor for detecting a temperature of gas at the refuse inlet of the main incinerator;

means for detecting a point at which the combustion in the main incinerator ends (which point is called "burn-out point");

means for rotating the main combustion incinerator about the longitudinal axis thereof to transfer the refuses through the main incinerator at a predetermined speed;

an air supply source for feeding the air into the main incinerator;

means for adjusting flow rate of the air to be fed into the main incinerator; and a controller for controlling the rotational speed of the incinerator rotating means and controlling the air flow rate adjusting means in a manner such that the gas temperature detected by the temperature sensor and the point detected by the burn-out point detecting means fall in respective predetermined ranges.

13. The apparatus according to claim 12, further including an oxygen sensor for detecting oxygen concentration of gas discharged upon combustion at the main incinerator.

14. The apparatus according to claim 12, further including means for pushing the refuses into the main incinerator.

15. The apparatus according to claim 13, further including means for pushing the refuses into the main incinerator.

16. The apparatus according to claim 12, further including means for dividing the air into a plurality of air streams.

17. The apparatus according to claim 15, further including means for dividing the air into a plurality of air streams.

18. The apparatus according to claim 12, further including means provided between the main incinerator and the melting furnace for transferring the ashes to the melting furnace from the main incinerator.

19. The apparatus according to claim 17, further including means provided between the main incinerator and the melting furnace for transferring the ashes to the melting furnace from the main incinerator.

20. The apparatus according to claim 17, wherein the refuse burn-out point detecting means includes a camera for obtaining image information of the combustion in the main incinerator and the apparatus further includes an image processor for processing the image information.

21. The method of claim 4, wherein the predetermined range for the point is less than 3.0 m from the outlet of the main incinerator when the total length of the main incinerator is 8.4 m.

22. The method of claim 5, wherein the predetermined range for the point is less than 3.0 m from the outlet of the main incinerator when the total length of the main incinerator is 8.4 m.

23. The method of claim 8, wherein the predetermined range for the point is less than 3.0 m from the outlet of the main incinerator when the total length of the main incinerator is 8.4 m.

* * * * *